US005174069A

United States Patent [19]

Thielenhaus

[11] Patent Number: 5,174,069

[45] Date of Patent: Dec. 29, 1992

[54] SYSTEM FOR GRINDING RINGS WITH MECHANICAL HOLDING

[75] Inventor: Ernst Thielenhaus, Wuppertal, Fed. Rep. of Germany

[73] Assignee: Ernst Thielenhaus KG, Wuppertal, Fed. Rep. of Germany

[21] Appl. No.: 778,739

[22] Filed: Oct. 18, 1991

[30] Foreign Application Priority Data

Oct. 24, 1990 [DE] Fed. Rep. of Germany ..... 4033725

[51] Int. Cl.[5] ..... B24B 49/04

[52] U.S. Cl. ..... 51/165.75; 51/73 R; 51/237 R; 51/291; 51/165.76

[58] Field of Search ..... 51/73 R, 165.76, 165.75, 51/236, 237 R, 281 P, 105 R, 291, 292, 149, 150, 154, 266, 267

[56] References Cited

U.S. PATENT DOCUMENTS 4,656,789 4/1987 Schwär ..... 51/291

*Primary Examiner*—Bruce M. Kisliuk
*Assistant Examiner*—Eileen Morgan
*Attorney, Agent, or Firm*—Herbert Dubno; Andrew Wilford

[57] ABSTRACT

A method of grinding an annular workpiece having an inner peripheral surface and an outer peripheral surface at least one of which is centered on a workpiece axis comprises the steps of holding the workpiece in a chuck rotatable about the axis and rotating the chuck and workpiece about the axis. A grinding tool is pressed radially against the one surface to remove material from the one surface and a cutting liquid is fed to the one surface to form thereon a liquid layer. A plurality of measuring shoes supported at angularly equispaced locations about the axis are urged radially toward the one surface. A jet of liquid is projected from each of the shoes against the one surface that forms a layer supporting the shoes on the one surface and merges with the layer of cutting liquid.

10 Claims, 3 Drawing Sheets

SYSTEM FOR GRINDING RINGS WITH MECHANICAL HOLDING

FIELD OF THE INVENTION

The present invention relates to a system for grinding rings. More particularly this invention concerns a measuring method used to control the grinding of rings such as bearing races.

BACKGROUND OF THE INVENTION

To finish an annular workpiece it is standard to hold it in an inside or outside chuck, depending on whether the outside or inside surface is to be machined, and to rotate it while pressing a grinding stone against the surface to be machined. To carry off particles and cool the grinding process it is standard to supply a cutting liquid to the site.

The workpiece is typically held in a chuck to rotate it relative to the nonrotating tool. If the inside periphery is being ground, the chuck engages the outside periphery, typically with three jaws to keep the workpiece on center. Conversely if the outside periphery is being ground the chuck engages the inside periphery, also with three jaws that bear radially outward.

It is necessary to monitor the grinding operation by taking periodic measurements of the surface being ground. Typically the radius of curvature of the surface being ground is continuously or intermittently measured and this measurement is compared in a control computer as an actual value against a set point representing the desired radius of curvature, and grinding is continued or stopped according to whether or not the desired size is attained.

These measurements are typically taken by means of feelers which mechanically touch the surface being machined with a tiny diamond point. Not only can such a procedure mar the surface, but it is also possible for the feeler to displace the workpiece in the chuck or even deform the workpiece slightly. In addition the workpiece inherently has microscopically eccentric regions that create vibrations in the measuring device that in turn give false readings.

In other machining operations contactless measurements are proposed. For instance a compressed-air jet can be directed from a nozzle at a surface being machined to create a restriction between the nozzle tip and the workpiece. The nozzle tip is held stationary so that the flow cross section of the restriction changes proportionately with the spacing between the nozzle tip and the workpiece surface. The pressure in the nozzle can be measured to determine workpiece spacing. Such a procedure is not normally extremely sensitive so it is unusable in, for instance, machining of bearing races.

It is also known when machining a flat surface to use a nozzle as described above, but emitting a continuous liquid stream, and to monitor liquid pressure as analogous to nozzle/surface spacing. Such a procedure cannot work on nonflat surfaces. Furthermore like the air-nozzle system, such an arrangement exerts a perceptible force against the workpiece which can displace it unless it is solidly clamped.

OBJECTS OF THE INVENTION

It is therefore an object of the present invention to provide an improved system for finish grinding.

Another object is the provision of such an improved system for finish grinding which overcomes the abovegiven disadvantages, that is which allows measurements to be taken that are not effected by minor irregularities in the workpiece, that do not themselves tend to shift or deform the workpiece, that do not respond to or create an offcenter condition of the workpiece, and that are highly accurate.

SUMMARY OF THE INVENTION

A method of grinding an annular workpiece having an inner peripheral surface and an outer peripheral surface at least one of which is centered on a workpiece axis comprises the steps of holding the workpiece in a chuck rotatable about the axis and rotating the chuck and workpiece about the axis. A grinding tool is pressed radially against the one surface to remove material from the one surface and a cutting liquid is fed to the one surface to form thereon a liquid layer. According to the invention a plurality of measuring shoes supported at angularly equispaced locations about the axis are urged radially toward the one surface. A jet of liquid is projected form each of the shoes against the one surface that forms a layer supporting the shoes on the one surface and merges with the layer of cutting liquid.

Such an arrangement has been found to completely eliminate vibration in the measuring shoes. Even if the workpiece is chucked offcenter, the liquid layer will automatically center the shoes and prevent them from vibrating. Hence highly accurate results will be obtained in every instance.

According to further features of the invention the radial positions of the shoes relative to the axis are monitored and the removal of material from the one surface is controlled by the grinding tool in accordance with the monitored radial positions. Furthermore the liquid projected from the shoes is also a cutting liquid so that it will not interfere with the grinding operation.

This liquid in accordance with the invention may be cooled and two diametrally opposite or three 120° spaced shoes may be used. Each shoe has a face juxtaposed with the one surface and of the same radius of curvature as the one surface and all the nozzles are of the same flow cross section. The pump is connected identically to all the nozzles to supply same with the liquid at the same pressure.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
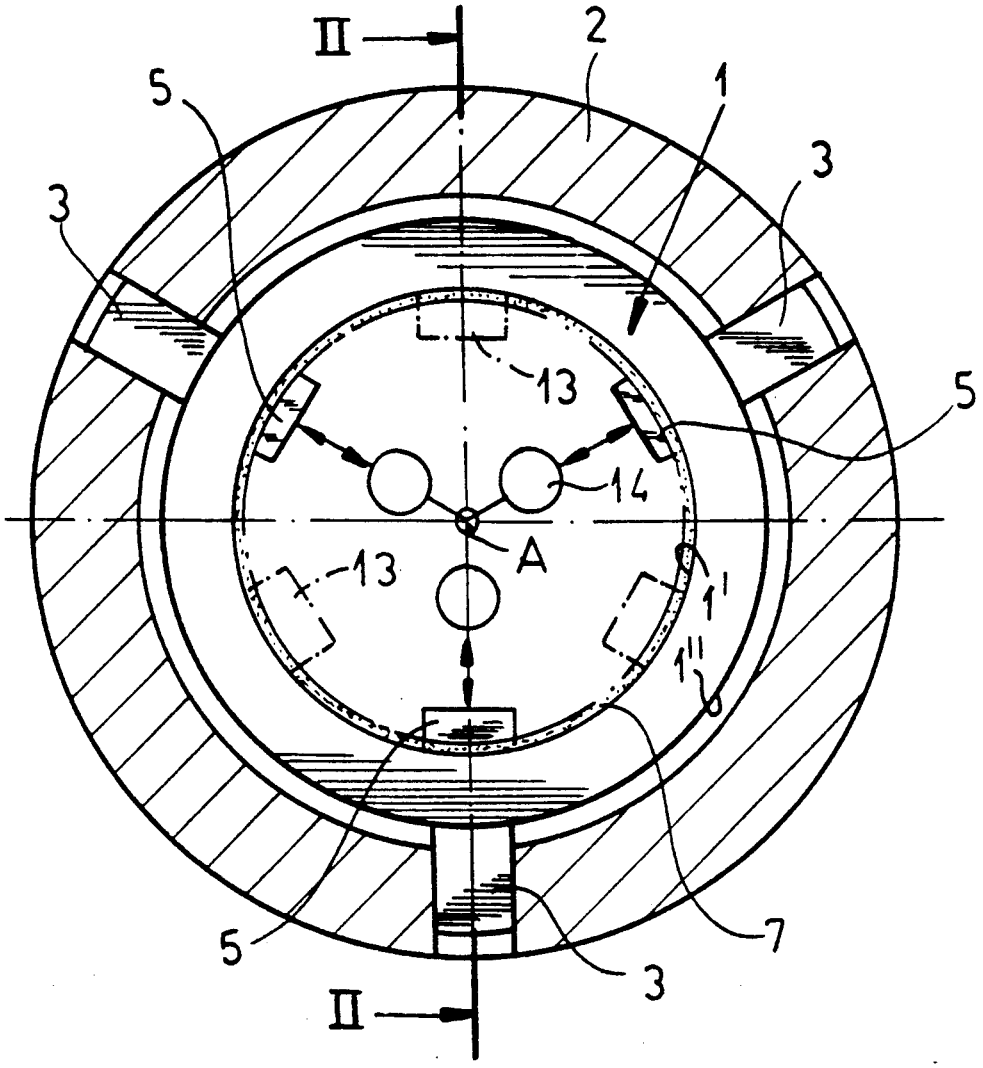
FIG. 1 is a partly diagrammatic cross section through the apparatus for carrying out the method of this invention.
Figure 2:
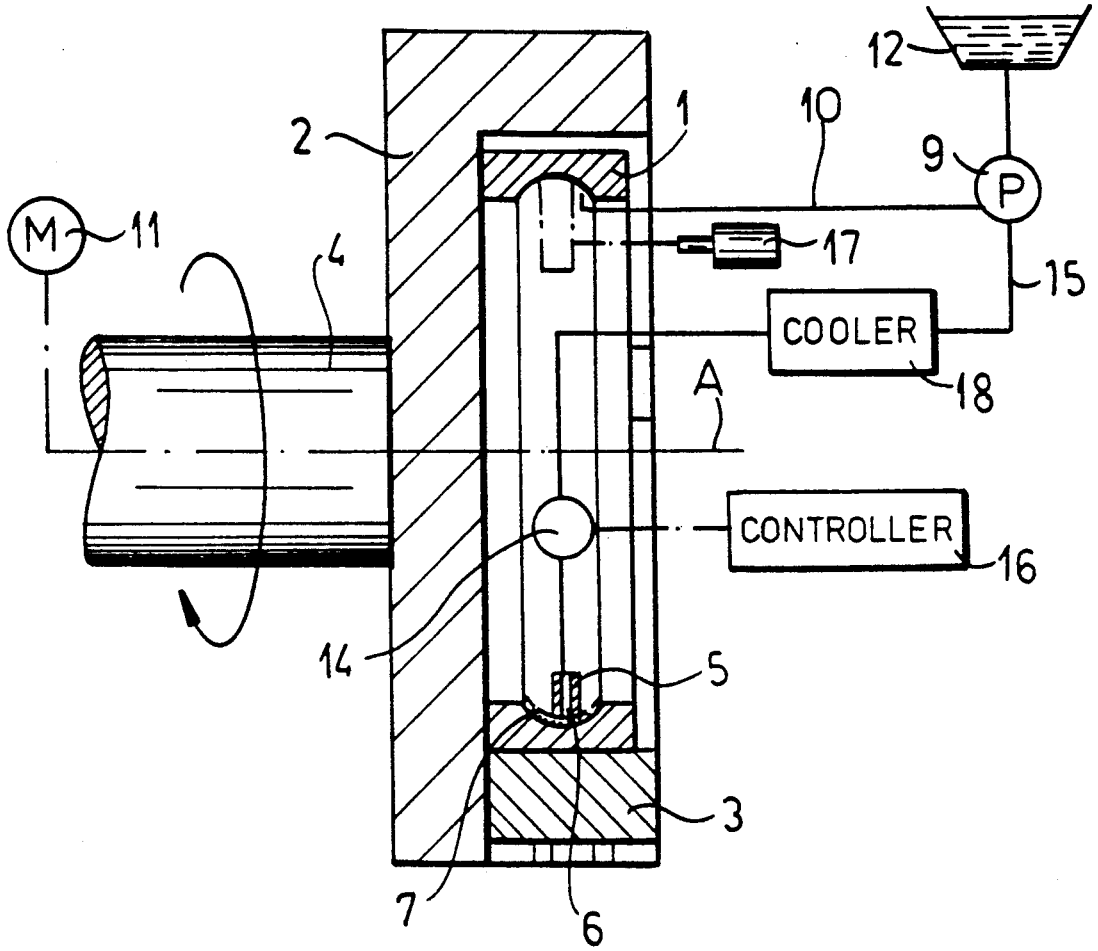
FIG. 2 is a partly diagrammatic axial section taken along line II—II of FIG. 1.

As seen in FIGS. 1 and 2 an annular workpiece 1 having an inner periphery 1' and an outer periphery 1'' is held in a chuck 2 having three jaws 3 angularly equispaced about a chuck-rotation axis A. The chuck 2 itself is carrie don a shaft 4 rotated by a motor shown schematically at 11. The workpiece 1 and the chuck 2 therefore rotate together about the horizontal axis A. Tools such as shown at dot-dash lines at 13 are pressed radially against the inner periphery 1' to machine it. The workpiece 1 here is a ball-bearing race. A pump 9 supplies cutting liquid from a supply 11 via a conduit 10 to the inner periphery 1' to cool and lubricate the surface being machined.

According to the invention three angularly equispaced feeler shoes 5 having outer faces complementary to the inner periphery 1' are urged radially outwardly against the inner periphery by actuators shown schematically at 14. These shoes 5 are fixed angularly, that is they do not rotate with the ring 1, and they are each formed with a radially outwardly open nozzle hole 6. The pump 9 is also connected via conduits 15 to these nozzle holes 6 to supply same with the liquid from the supply 11, here a cutting liquid, so as to form on the inner periphery 1' at the feet 5 a film 7, here shown in exaggerated scale for clarity of view. Thus each of the feeler feet 5 does not actually touch the ring 1, but rides on it on a film of liquid several microns thick.

In accordance with the invention the actuators 14 incorporate position detectors connected to a controller 16 that is connected to the drive motor 11 and/or to actuators 17 for the tools 13. Thus the grinding operation can be stopped when the monitored region, here a groove race, of the inner periphery 1' has the desired diameter. The detected positions of all the shoes 5 can be combined to get an overall reading, or they can be individually weighted against a common set point.

FIG. 2 also shows how a cooler 18 can be provided to cool the liquid fed to the shoes 5. Thus this liquid can be used also to dissipate the heat generated by machining.

Figure 3:
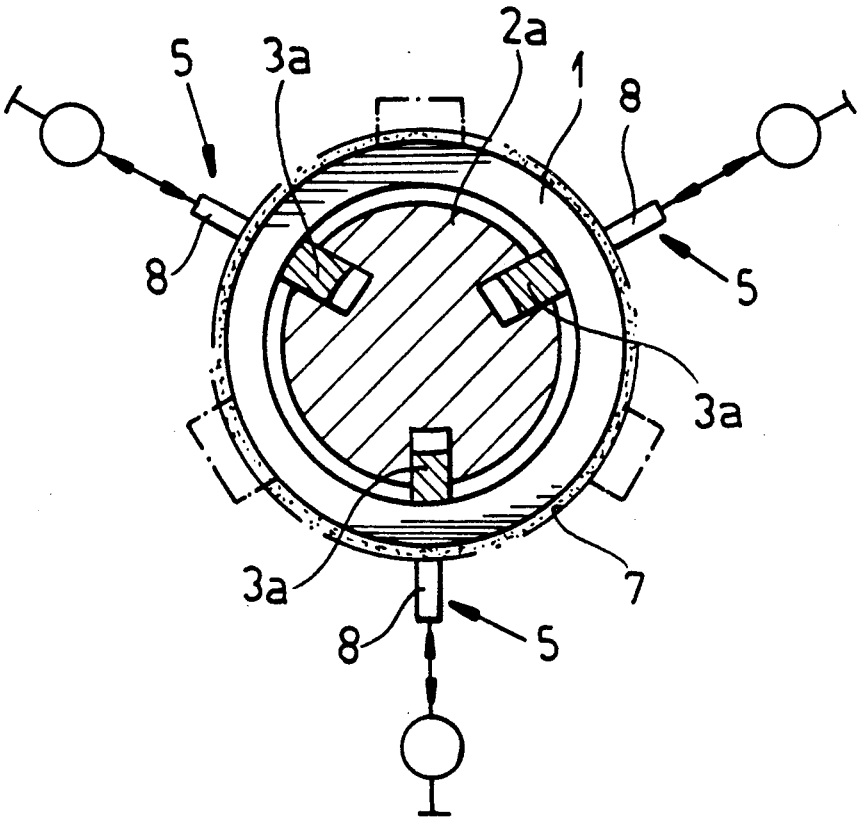
FIG. 3 is a small-scale view like FIG. 1 illustrating a variant of the system of this invention.

FIG. 3 shows an arrangement wherein references identical to those of FIG. 1 are used, but where the tools 13 and shoes 5 ride on the outside periphery 1'' of the workpiece 1 and an inside chuck 2*a* with jaws 3*a* is provided that engages within the workpiece 1'.

I claim:

1. A method of grinding an annular workpiece having an inner peripheral surface and an outer peripheral surface at least one of which is centered on a workpiece axis, the method comprising the steps of:

holding the workpiece in a chuck rotatable about the axis;

rotating the chuck and workpiece about the axis;

engaging a grinding tool radially against one of the peripheral surfaces and thereby removing material from the one surface;

feeding a cutting liquid to the one surface to form thereon a liquid layer;

supporting a plurality of measuring shoes at angularly equispaced locations about the axis and urging the shoes radially toward the one surface; and projecting form each of the shoes against the one surface a jet of liquid that forms a layer supporting the shoes on the one surface and merges with the layer of cutting liquid.

2. The method defined in claim 1, further comprising the steps of;

monitoring the radial positions of the shoes relative to the axis; and controlling the removal of material from the one surface by the grinding tool in accordance with the monitored radial positions.

3. The method defined in claim 1 wherein the liquid projected from the shoes is also a cutting liquid.

4. The method defined in claim 1, further comprising the step of cooling the liquid projected from the shoes.

5. The method defined in claim 1 wherein there are three such shoes angularly equispaced about the axis.

6. An apparatus for grinding an annular workpiece having an inner peripheral surface and an outer peripheral surface at least one of which is centered on a workpiece axis, the apparatus comprising:

a chuck rotatable about an axis;

drive means for rotating the chuck and workpiece about the axis;

a grinding tool engageable radially against one of the peripheral surfaces whereby the tool can remove material form the one surface;

means for feeding to the one surface a cutting liquid forming a layer on the one surface;

a plurality of measuring shoes;

means for supporting the shoes at angularly equispaced locations about the axis and for urging the shoes radially toward the one surface, each of the shoes being formed with a nozzle open radially toward the one surface; and pump means connected to the nozzles for projecting from each of the nozzles against the one surface a jet of liquid such that the liquid forms a layer supporting the shoes on the one surface and merging with the cutting-liquid layer.

7. The apparatus defined in claim 6 wherein each shoe has a face juxtaposed with the one surface and of the same radius of curvature as the one surface.

8. The apparatus defined in claim 6 wherein all the nozzles are of the same flow cross section, the pump means being connected identically to all the nozzles to supply same with the liquid at the same pressure.

9. The apparatus defined in claim 6, further comprising means for detecting the radial positions of the shoes relative to the axis and for generating an output corresponding to the detected position;

control means connected between the connecting means and the grinding tool for controlling grinding in accordance with the detected position.

10. The apparatus defined in claim 6, further comprising a single supply of cutting liquid, the means for feeding and the pump means both being connected to the supply for taking the liquid therefrom.

* * * * *